US006746995B2

(12) United States Patent
Cao et al.

(10) Patent No.: US 6,746,995 B2
(45) Date of Patent: Jun. 8, 2004

(54) WASH CYCLE UNIT DOSE SOFTENER CONTAINING A CONTROLLED AMOUNT OF MOISTURE

(75) Inventors: Hoai-Chau Cao, Ans (BE); Alain Gourgue, Lincent (BE); Alain Jacques, Blegny (BE); Joseph Reul, Heusy (BE); Juliette Rousselet, Bassenge (BE); Jeffrey T. Epp, Arlington, NJ (US); Amjad Farooq, Hillsborough, NJ (US); Charles J. Schramm, Jr., Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 139 days.

(21) Appl. No.: 10/171,448

(22) Filed: Jun. 13, 2002

(65) Prior Publication Data

US 2003/0232735 A1 Dec. 18, 2003

(51) Int. Cl.[7] ..... C11D 17/00

(52) U.S. Cl. ..... 510/298; 510/446; 510/507; 510/515

(58) Field of Search ..... 510/298, 446, 510/507, 515

(56) References Cited

U.S. PATENT DOCUMENTS

| | | | | | |
|---|---|---|---|---|---|
| 4,569,773 | A | | 2/1986 | Ramachandran et al. | 252/8.7 |
| 4,605,506 | A | | 8/1986 | Wixon | 252/8.75 |
| 4,818,421 | A | | 4/1989 | Boris et al. | 252/8.8 |
| 4,851,138 | A | | 7/1989 | Jaroschek et al. | 252/88 |
| 4,894,117 | A | * | 1/1990 | Bianchi et al. | 159/49 |
| 5,225,100 | A | | 7/1993 | Fry et al. | 252/174.25 |
| 5,300,236 | A | * | 4/1994 | Bortolotti et al. | 510/334 |
| 5,358,647 | A | * | 10/1994 | Puentes-Bravo et al. | 510/328 |
| 5,972,870 | A | | 10/1999 | Anderson | 510/298 |
| 6,258,767 | B1 | | 7/2001 | Jacques et al. | 510/298 |
| 6,291,421 | B1 | | 9/2001 | Jacques et al. | 510/515 |
| 6,294,516 | B1 | | 9/2001 | Jacques et al. | 510/515 |

* cited by examiner

*Primary Examiner*—John R. Hardee
(74) *Attorney, Agent, or Firm*—Bernard Lieberman

(57) ABSTRACT

A unit dose wash cycle fabric softening composition for softening or conditioning fabrics in the wash cycle of an automatic washing machine, said unit dose comprising a compacted granular fabric softener composition formed from granules of softener, which granules are formed from a powder of said clay component wherein the amount of moisture in said clay component is from about 3% to about 10%, by weight, and wherein the total amount of moisture in the compacted fabric softener composition is from about 3% to about 25% by weight.

20 Claims, No Drawings

WASH CYCLE UNIT DOSE SOFTENER CONTAINING A CONTROLLED AMOUNT OF MOISTURE

FIELD OF THE INVENTION

This invention relates to wash cycle unit dose laundry compositions for softening or conditioning fabrics. More particularly, this invention relates to unit dose fabric softening compositions which are compacted granular compositions suitable for use in the wash cycle of an automatic washing machine.

BACKGROUND OF THE INVENTION

Detergent compositions manufactured in the form of compacted detergent powder are known in the art. U.S. Pat. No. 5,225,100, for example, describes a tablet of compacted powder comprising an anionic detergent compound, which will adequately disperse in the wash water.

U.S. Pat. Nos. 6,258,767; 6,294,516 and 6,291,421 assigned to Colgate-Palmolive Company describe unit dose granular and encapsulated liquid fabric softening compositions suitable for use as an additive to the wash cycle of a washing machine, or during hand washing of laundry.

Another possible option for providing a unit dose softener apart from the wash cycle is to introduce the softening ingredients directly into the rinse cycle. But, for this type of product to be effective several practical requirements must be met. To begin with, the size and shape of the unit dose container must be readily compatible with the geometry of a wide variety of rinse cycle dispensers designed for home washing machines in order to insure its easy introduction into the dispenser. Moreover, in common with the general use of rinse cycle softeners, it is necessary to clean the rinse dispenser on a regular basis to avoid residue from accumulating within the dispenser or even, at times, prevent bacterial growth from occurring.

Still further, a unit dose composition for the rinse cycle must be formulated to readily dispense its contents upon contact with water in a period of time corresponding to the residence time of the unit dose in the dispenser, namely, the period of time during which water enters and flows through the rinse cycle dispenser. The aforementioned practical requirements have to date not been successfully met with any commercially available product and hence there remains a need in the art for a unit dose softener capable of activation in the rinse cycle.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No. 4,818,421 to Boris et al. and U.S. Pat. No. 4,569,773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water. It has now been found that softening of laundry can be effected in the wash cycle with a flexibility which is independent of the detergent dosage, and with great convenience by the consumer by the use of a compacted granular unit dose wash cycle softener which avoids the common problems associated with the pouring and handling of granular or liquid detergent compositions, and which provides enhanced dispersibility of the compacted granular composition in the wash water.

SUMMARY OF THE INVENTION

There is provided herein a unit dose wash cycle fabric softening composition for softening or conditioning fabrics which is readily dispersible during hand wash or in the wash cycle of an automatic washing machine, said unit dose comprising a compacted granular fabric softener composition comprising a softening clay component in an amount sufficient to form a unit dose capable of providing effective softening or conditioning of fabrics in the wash cycle of said washing machine, and wherein said compacted fabric softener composition is formed from granules of softener, which granules are formed from a powder of said clay component wherein the amount of moisture in said clay component is from about 3% to about 10%, by weight, and wherein the total amount of moisture in the compacted fabric softener composition is from about 3% to about 25% by weight.

The moisture levels of the clay component and compacted softener composition as described herein are determined by measuring the weight loss after heating the particular material at 105° C. for 4 hours in a closed oven.

In a preferred embodiment the unit dose fabric softening composition is characterized by being in the form of a tablet and having no discrete outer layer surrounding the fabric softener comprised of an alkaline material such that the pH of the wash water is increased upon dissolution of said outer layer in said wash water.

The term "granular" as used herein in describing the fabric softener is intended to encompass relatively coarser granules varying in size from about 150 to 2,000 microns as well as finer powder having a size as small as 30 to 50 microns.

The term "fabric softener" is used herein for purposes of convenience to refer to materials which provide softening and/or conditioning benefits to fabrics in the wash cycle of a home or automatic laundering machine.

The compacted granular fabric softener composition of the invention is comprised of a "softening clay component" which is a term used herein to refer to a fabric softening clay used by itself or optionally in combination with an organic fatty softening material. Especially preferred fabric softeners comprise a clay mineral softener, such as bentonite, in combination with a pentaerythritol ester compound as further described herein. Useful combinations of such softener may vary from about 80%, to about 90%, by weight, of clay, and from about 10% to about 20%, by weight, of fatty softening material such as a pentaerythritol compound (often abbreviated herein as "PEC").

It has been discovered that the amount of moisture in the powder of the clay component and in the compacted softener composition significantly affect the deposition of residue on the washed fabrics. Accordingly, the preferred amount of moisture in the clay component is from about 3.5% to about 7.5%, by weight, and the total amount of moisture in the compacted fabric softener composition is from about 3% to about 15%, by weight.

In accordance with the process aspect of the invention there is provided a process for softening or conditioning laundry which comprises contacting the laundry with an effective amount of the unit dose laundry composition defined above.

DETAILED DESCRIPTION OF THE INVENTION

The clays that are useful components of the invented products include the montmorillonite-containing clays which have swelling properties (in water) and which are of smectite structure, so that they deposit on fibrous materials, especially cotton and cotton/synthetic blends, such as cotton/polyester, to give such fibers and fabrics made from them a surface lubricity or softness. The best of the smectite clays for use in the present invention is bentonite and the best of the bentonites are those which have a substantial swelling capability in water, such as the sodium and potassium bentonites. Such swelling bentonites are also known as western or Wyoming bentonites, which are essentially sodium bentonite. Other bentonites, such as calcium bentonite, are normally non-swelling and usually are, in themselves, unacceptable as fabric softening agents. However, it has been found that such non-swelling bentonites exhibit even better fabric softening in combination with PEC's than do the swelling bentonites, provided that there is present in the softening composition, a source of alkali metal or other solubilizing ion, such as sodium (which may come from sodium hydroxide, added to the composition, or from sodium salts, such as builders and fillers, which may be functional components of the composition). Among the preferred bentonites are those of sodium and potassium, which are normally swelling, and calcium and magnesium, which are normally non-swelling. Of these it is preferred to utilize calcium (with a source of sodium being present) and sodium bentonites. The bentonites employed may be produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Also, other montmorillonite-containing smectite clays of properties like those of the bentonites described may be substituted in whole or in part for the bentonites described herein and similar fabric softening results will be obtained.

The swellable bentonites and similarly operative clays are of ultimate particle sizes in the micron range, e.g., 0.01 to 20 microns and of actual particle sizes in the range of No's. 100 to 400 sieves, preferably 140 to 325 sieves, U.S. Sieve Series. The bentonite and other such suitable swellable clays may be agglomerated to larger particle sizes too, such as 60 to 120 sieves, but such agglomerates are not preferred unless they include the PEC('s) too (in any particulate products).

In a preferred embodiment of the invented compositions and articles of the present invention, there is included in combination with the fabric softening clay, an organic fatty softener to provide enhanced softening of laundry. The organic softener can be anionic, cationic or nonionic fatty chains ($C_{10}$–$C_{22}$ preferably $C_{12}$–$C_{18}$). Anionic softeners include fatty acids soaps. Preferred organic softeners are nonionics such as fatty esters, ethoxylated fatty esters, fatty alcohols and polyols polymers. The organic softener is most preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound is often abbreviated as PEC herein, which description and abbreviation may apply to any or all of pentaerythritol, oligomers, thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two, e.g., 1 or 2 to 4, are esterified by a higher fatty acid or other higher aliphatic acid, which can be of an odd number of carbon atoms.

The higher fatty acid esters of the pentaerythritol compounds are preferably partial esters. And more preferably there will be at least two free hydroxyls thereon after esterification (on the pentaerythritol, oligomer or alkoxyalkane groups). Frequently, the number of such free hydroxyls is two or about two but sometimes it may by one, as in pentaerythritol tristearate. The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as tallow or coconut oil, or from such natural materials that have been hydrogenated. Synthetic acids of odd or even numbers of carbon atoms may also be employed. Of the fatty acids lauric and stearic acids are often preferred, and such preference may depend on the pentaerythritol compound being esterified.

Examples of some esters (PEC's) within the present invention follow:

Monopentaerythritol Esters

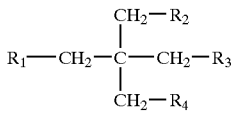

Monopentaerythritol Dilaurate $R_1$=$CH_3$—$(CH_2)_{10}$—COO—
$R_2$=$CH_3$—$(CH_2)_{10}$—COO—
$R_3$=OH
$R_4$=OH Monopentaerythritol Monostearate $R_1$=$CH_3$—$(CH_2)_{16}$—COO—
$R_2$=OH
$R_3$=OH
$R_4$=OH Monopentaerythritol Distearate $R_1$=$CH_3$—$(CH_2)_{16}$—COO—
$R_2$=$CH_3$—$(CH_2)_{16}$—COO—
$R_3$=OH
$R_4$=OH Monopentaerythritol Tristearate $R_1$=$CH_3$—$(CH_2)_{16}$—COO—
$R_2$=$CH_3$—$(CH_2)_{16}$—COO—
$R_3$=$CH_3$—$(CH_2)_{16}$—COO—
$R_4$=OH Monopentaerythritol Monobehenate $R_1$=$CH_3$—$(CH_2)_{20}$—COO—
$R_2$=OH
$R_3$=OH
$R_4$=OH Monopentaerythritol Dibehenate $R_1$=$CH_3$—$(CH_2)_{20}$—COO—
$R_2$=$CH_3$—$(CH_2)_{20}$—COO—
$R_3$=OH
$R_4$=OH Dipentaerythritol Esters

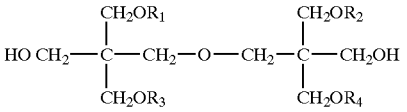

Dipentaerythritol Tetralaurate $R_1$=$CH_3$—$(CH_2)_{10}$—CO
$R_2$=$CH_3$—$(CH_2)_{10}$—CO
$R_3$=$CH_3$—$(CH_2)_{10}$—CO
$R_4$=$CH_3$—$(CH_2)_{10}$—CO Dipentaerythritol Tetrastearate $R_1$=$CH_3$—$(CH_2)_{16}$—CO
$R_2$=$CH_3$—$(CH_2)_{16}$—CO
$R_3$=$CH_3$—$(CH_2)_{16}$—CO
$R_4$=$CH_3$—$(CH_2)_{16}$—CO Pentaerythritol 10 Ethylene Oxide Ester

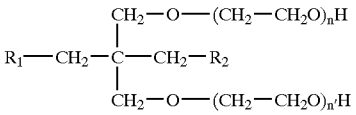

with n + n′ = 10

Monopentaerythritol 10 Ethylene Oxide Distearate $R_1$=$CH_3$—$(CH_2)_{16}$—COO—
$R_2$=$CH_3$—$(CH_2)_{16}$—COO—

Pentaerythritol 4 Propylene Oxide Esters

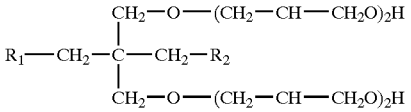

Monopentaerythritol 4 Propylene Oxide Monostearate $R_1$=$CH_3$—$(CH_2)_{16}$—COO—
$R_2$=OH Monopentaerythritol 4 Propylene Oxide Distearate $R_1$=$CH_3$—$(CH_2)_{16}$—COO—
$R_2$=$CH_3$—$(CH_2)_{16}$—COO—

Although in the formulas given herein some preferred pentaerythritol compounds that are useful in the practice of this invention are illustrated it will be understood that various other such pentaerythritol compounds within the description thereof may also be employed herein, including such as pentaerythritol dihydrogenated tallowate, pentaerythritol ditallowate, pentaerythritol dipalmitate, and dipentaerythritol tetratallowate.

To enhance the softening efficacy of the unit dose compositions described herein cationic softeners such as conventional quaternary ammonium softening compounds may optionally be added in minor amounts.

The combination of bentonite and organic fatty softening material is generally from about 10% to about 100% bentonite and from about 1% to about 100% fatty softening material, preferably from about 50% to about 95% bentonite and about 5% to about 50% fatty softening material, and most preferably from about 80% to 90% bentonite and from about 10% to about 20% fatty softening material.

Other useful ingredients for the unit dose compacted granular compositions of the invention include disintegration materials to enhance the disintegration of the unit dose in the wash water. Such materials include an effervescent matrix such as citric acid combined with baking soda, or materials such as PVP polymer and cellulose. Granulating agents may be used such as polyethylene glycol; bactericides, perfumes, dyes and materials to protect against color fading, dye transfer, anti-pilling and anti-shrinkage. For purposes of enhancing the aesthetic properties of the final composition, cosmetic ingredients such as dyes, micas and waxes may be used as coating ingredients to improve the appearance and feel of the unit dose.

Clay/PDT granules and tablets are conveniently made following five major steps:

a) PDT oversprayed onto clay powder
b) Agglomeration of clay/PDT powder to make granules
c) Fragrances and color dyes addition to clay/PDT granules
d) Blending with powder disintegration system to form a particulate composition
e) Compaction into tablets The first step of the process is to spray molten PDT onto the clay powder in a rotary drum.

The agglomeration step is designed to form granules. Both batch and continuous granulation equipment is suitable for the task. A drying step is usually employed to condition the granules. Rotary or fluid bed dryers are examples of suitable drying/conditioning equipment.

Fragrances and color dye solutions are then applied to the clay PDT granules. Preferred mixing devices include both batch and continuous rotary mixers (ie rotary drums, twin shell mixers).

To prepare the product for tableting, the powder disintegration system is blended to the clay PDT granules using both continuous and batch mixing systems, with the preferred ones having minimum shear on the granules.

The blended granules are finally compacted into tablets using alternative or high speed rotative presses. Ideal tableting conditions balance tablet hardness which promotes consumer preferred disintegration and durability to survive the shipping process.

EXAMPLE 1

A compacted granular unit dose composition was prepared from the following ingredients:

| | Weight Percent |
|---|---|
| Clay/Pentaerythritol ditallowate (PDT) in a ratio of 83%:17% | 79.97% |
| Effervescent matrix of baking soda and citric acid | 17% |
| Polyvinylpyrrolidone | 1% |
| Perfume | 2% |
| Dye | 0.03% |

This method of manufacture was as described above. The weight of the spherical unit dose was 60 g and such unit dose dispersed in water within 20 minutes when introduced in the wash load at the beginning of the wash in a European Miele W832 front loading washing machine set a Program White Colors at 40° C.

The softness provided by the unit dose compositions on terry towels, cotton tee-shirts and cotton kitchen towels was evaluated after cumulative washes and compared with a commercial liquid fabric softener. A 3 Kg laundry ballast was used in the machine. Softness was evaluated by a panel of six judges using 9 replicates. The results were as follows:

SOFTNESS EVALUATION

| Laundry Item | Softness Comparison |
|---|---|
| Terry towels | 1 unit dose softener composition of the invention provided equivalent softness to commercial liquid FS after 10 cumulative wash cycles |
| Cotton tee-shirts | 1 unit dose softener provided equivalent softness to commercial liquid FS after one wash cycle |
| Cotton kitchen towels | 1 unit dose softener provided enhanced softening relative to commercial liquid FS after one wash cycle |

EXAMPLE 2

Tablets containing clay/PDT having moisture levels of 10.0%; 8.0%; 7.0% and 5% were prepared with the following ingredients:

| | A | B | C | D |
|---|---|---|---|---|
| | Weight Percent | | | |
| Clay/Pentaerythritol ditallowate (PDT) in a ratio of 83%:17% | 80.0 | | | |
| Disintegrating agents | 15.7 | | | |
| Perfume | 4.3 | | | |
| Moisture content in Clay/PDT (%) | 10.0 | 8.0 | 7.0 | 5.0 |

The moisture levels of the clay/PDT powders were determined by measuring the weight loss after heating the powder at 105° C. during 4 hours in a closed oven.

The ingredients were then blended together, and the perfume then added to the powder. The powder was compacted using an alternative or rotary press as described above. The weight of the tablets was approximately 19 gr.

The tablets were aged at 43° for four weeks. After which the clay tablets were each put in an European Miele W832 front loading automatic washing machine, set at Program "White and Colors at 40° C.". A 3 Kg laundry ballast was used in the machine.

The residues left in the washing machines through the washing process were measured as following:

At various intervals of time along the wash and rinse cycles, the machine was stopped and the remaining tablet was weighed. The tablet was then put back in the machine and the washing program continued. This operation was repeated until complete disintegration of the tablet. The weights recorded are expressed as percentage of residues compared to the initial tablet weight.

TABLE 1

Tablet Dispersion as a Function of Moisture Content of Clay
Percent Residues Remaining in Washing Machine $$\text{Residues (\%)} = \frac{\text{Weight of tablet after interval of washing time}}{\text{Weight of initial tablet}} \times 100$$

| Moisture Level in Clay/PDT | 10 Min. Wash | 1st Rinse | 2nd Rinse | End Wash |
|---|---|---|---|---|
| 10.0% | 86% | 71% | 65% | 61% |
| 8.0% | 27% | 0 | 0 | 0 |
| 7% | 9% | 0 | 0 | 0 |
| 5% | 0 | 0 | 0 | 0 |

Based on the data of Table 1, it is clear that to obtain good tablet dispersion for a compacted softener composition subject to ageing at high temperatures, reflecting the effects of long term ageing at ambient temperature, the moisture of the clay component should be kept within the defined ranges of the invention. Further, to prevent the unwanted transfer of moisture from other ingredients in the unit dose softening composition to the clay component, the total amount of moisture in the compacted softener composition must similarly be regulated to be within the defined ranges of the present invention.

What is claimed is:

1. A unit dose wash cycle fabric softening composition for softening or conditioning fabrics which is readily dispersible during hand wash or in the wash cycle of an automatic washing machine, said unit dose comprising a compacted granular fabric softener composition comprising a softening clay component in an amount sufficient to form a unit dose capable of providing effective softening or conditioning of fabrics in the wash cycle of said washing machine, and wherein said compacted fabric softener composition is formed from granules of softener, which granules are formed from a powder of said clay component wherein the amount of moisture in said clay component is from about 3% to about 10%, by weight, and wherein the total amount of moisture in the compacted fabric softener composition is from about 3% to about 25% by weight.

2. A unit dose softening composition as in claim 1 characterized by being in the form of a tablet and having no discrete outer layer surrounding the fabric softener comprised of an alkaline material such that the pH of the wash water is increased upon the dissolution of said outer layer in said wash water.

3. A unit dose softening composition as in claim 1 wherein the amount of moisture in the clay component is from about 3.5% to about 7.5%, by weight, and the total amount of moisture in the compacted fabric softener composition is from about 3 to about 15% by weight.

4. A unit dose softening composition as in claim 1 wherein said fabric softener composition comprises a softening clay in combination with an organic fatty softening material.

5. A unit dose softening composition as in claim 4 wherein said softening clay is a montmorillonite-containing clay and said organic fatty softening material is a pentaerythritol compound ("PEC") selected from the group consisting of a higher aliphatic acid ester of pentaerythritol, an oligomer of pentaerythritol, a lower alkylene oxide derivative of an oligomer of pentaerythritol, and a mixture thereof.

6. A unit dose softening composition as in claim 4 wherein said softening clay is a montmorillonite-containing clay and said organic fatty softening material is a fatty alcohol.

7. A unit dose softening composition as in claim 4 wherein said softening clay is at least partially coated with said organic fatty softening material and serves as a carrier for such fatty softening material.

8. A unit dose softening composition as in claim 4 wherein said softening clay is bentonite and said PEC is a higher aliphatic ester of pentaerythritol or of an oligomer of pentaerythritol.

9. A unit dose softening composition as in claim 4 wherein the combination of clay and fatty softening material comprises, by weight, from about 50% to about 95% of bentonite and from about 5% to about 50% of said PEC.

10. A unit dose softening composition as in claim 9 wherein said combination of clay and fatty softening material comprises from about 80 to about 90% of bentonite and from about 10% to about 20% of said PEC.

11. A unit dose softening composition as in claim 1 wherein said fabric softener further includes a liquid fatty ester.

12. A unit dose softening composition as in claim 11 wherein said fatty ester is sunflower oil.

13. A unit dose softening composition as in claim 1 wherein said fabric softener composition further includes a liquid silicone.

14. A unit dose softening composition as in claim 1 wherein said fabric softener composition further includes a liquid oleyl alcohol.

15. A process for softening or conditioning laundry which comprises contacting the laundry with an effective amount of the unit dose softening composition of claim 1.

16. A process according to claim 15 wherein the fabric softener composition comprises a softening clay in combination with an organic fatty softening material.

17. A process according to claim 16 wherein said softening clay is bentonite and said organic softening material comprises a fatty alcohol or pentaerythritol compound (PEC) selected from the group consisting of a higher aliphatic acid ester of pentaerythritol, an oligomer of pentaerythritol, a lower alkylene oxide derivative of an oligomer of pentaerythritol, and a mixture thereof.

18. A process according to claim 15 wherein the fabric softener composition comprises a liquid fatty ester.

19. A process according to claim 15 wherein said fatty ester is sunflower oil.

20. A process according to claim 15 wherein the amount of moisture in the clay component is from about 3.5% to about 7.5%, by weight, and the total amount of moisture in the compacted fabric softener composition is from about 3% to about 15%, by weight.

* * * * *